US011787608B2

(12) United States Patent
Lee et al.

(10) Patent No.: US 11,787,608 B2
(45) Date of Patent: Oct. 17, 2023

(54) DISCHARGE-TYPE CAP AND BOTTLE HAVING THE SAME

(71) Applicant: Byung Dae Lee, Cumming, GA (US)

(72) Inventors: Byung Dae Lee, Cumming, GA (US); Ensam Lee, Brooklyn, NY (US); Enbe Lee, Brooklyn, NY (US)

(73) Assignee: Byung Dae Lee, Cumming, GA (US)

( * ) Notice: Subject to any disclaimer, the term of this patent is extended or adjusted under 35 U.S.C. 154(b) by 0 days.

(21) Appl. No.: 17/686,583

(22) Filed: Mar. 4, 2022

(65) Prior Publication Data

US 2023/0211927 A1 Jul. 6, 2023

(30) Foreign Application Priority Data

Jan. 5, 2022 (KR) ..... 20-2022-0000028

(51) Int. Cl.
*B65D 47/20* (2006.01)

(52) U.S. Cl.
CPC ..... *B65D 47/2006* (2013.01)

(58) Field of Classification Search
CPC .. A47G 21/18; A47G 19/2272; B65D 47/065; B65D 47/066; B65D 1/323
See application file for complete search history.

(56) References Cited

U.S. PATENT DOCUMENTS 2,127,874 A * 8/1938 Leonard ..... F16N 3/06 222/211
2,670,882 A * 3/1954 Best ..... B05B 7/2408 222/542
3,181,743 A * 5/1965 Libit ..... B65D 47/066 222/545
4,487,342 A * 12/1984 Shy ..... B65D 47/2006 222/536
5,083,683 A * 1/1992 Knickerbocker ... B05B 11/0037 222/464.7
8,281,960 B1 * 10/2012 Gers ..... B05B 15/30 222/464.7
2004/0217187 A1 * 11/2004 Renz ..... A47G 21/18 239/33
2006/0226110 A1 * 10/2006 Choi ..... B65D 47/066 220/203.04
2010/0181329 A1 * 7/2010 Davies ..... A47G 19/2272 220/707
2010/0288794 A1 * 11/2010 Chapin ..... B05B 15/30 222/377

FOREIGN PATENT DOCUMENTS

FR 1167881 A * 12/1958

* cited by examiner

*Primary Examiner* — Donnell A Long
(74) *Attorney, Agent, or Firm* — Dinsmore & Shohl LLP

(57) ABSTRACT

A discharge-type cap includes an outer housing detachably coupled to an inner surface of an upper opening of a container, a button portion hinged to an upper portion of the outer housing, and a tube having one end located in a lower portion of the outer housing and the other end located on a side of the button portion. The button portion includes an upper tube insertion hole which has a lower surface and a side surface communicating to each other and into which the tube is inserted, and the outer housing includes a lower tube insertion hole having a central portion into which the tube is inserted and inclined in a direction in which the other end of the tube is located.

7 Claims, 5 Drawing Sheets

DISCHARGE-TYPE CAP AND BOTTLE HAVING THE SAME

CROSS-REFERENCE TO RELATED APPLICATIONS

The present application claims priority under 35 U.S.C 119(a) to Korean Patent Application No. 20-2022-0000028, filed on Jan. 5, 2022, which is incorporated herein by reference in its entirety.

BACKGROUND

1. Technical Field

The present disclosure relates to a discharge-type cap and a bottle including the discharge-type cap.

2. Related Art

In general, a material such as a liquid phase material, a paste phase material, or a gel phase material is accommodated in a container to be stored and distributed. In particular, a material with viscosity such as cream, lotion, conditioner, shampoo, hair gel, or so on is accommodated in a pressure-type pumping device that is mainly pumped by a pressing action of a pressure button to be stored and distributed. The pressure-type pumping device has a structure in which, when a user presses a pressure button by hand, a material accommodated in a container is pumped by the pressing force and ejected to the outside by a preset amount through a nozzle.

As described above, a nozzle structure is complicated to cause assembly and production to take a long time, and thus, it is difficult to increase productivity, and a production cost increases due to diversification of peripheral components for operating the nozzle.

SUMMARY

The present disclosure is to solve the problems of the related art described above and aims to provide a discharge-type cap that ejects a liquid in a container to the outside through a tube when a button portion is pressed, and the container is pressurized and blocks the tube when the button portion is returned to an original position.

Additional aspects will be set forth in part in the description which follows and, in part, will be apparent from the description, or may be learned by practice of the presented embodiments of the disclosure.

According to an aspect of the present disclosure, a discharge-type cap includes an outer housing detachably coupled to an inner surface of an upper opening of a container, a button portion hinged to an upper portion of the outer housing, and a tube having one end located in a lower portion of the outer housing and the other end located on a side of the button portion, wherein the button portion includes an upper tube insertion hole which has a lower surface and a side surface communicating to each other and into which the tube is inserted, the outer housing includes a lower tube insertion hole having a central portion into which the tube is inserted and inclined in a direction in which the other end of the tube is located, the button portion is in an open state when pressurizing an upper portion of an opposite portion where the other side of the tube is located and is in a closed state when pressurizing an upper portion of a part where the other side of the tube is located, and, when the button portion is in the closed state, the tube is in a folded closed state, and when the button portion is in the open state, the tube is in an open state.

According to the present disclosure, when a button portion is pressed and the container is pressurized, a liquid in a container is ejected to the outside through a tube, and when the button portion is returned to an original position, the tube is blocked, and thus, there is an effect in which the container may be easily used and a manufacturing cost may be reduced.

BRIEF DESCRIPTION OF THE DRAWINGS

Various embodiments of the present disclosure will become more apparent in view of the attached drawings and accompanying detailed description, in which.

DETAILED DESCRIPTION OF THE EMBODIMENTS

Figure 1:
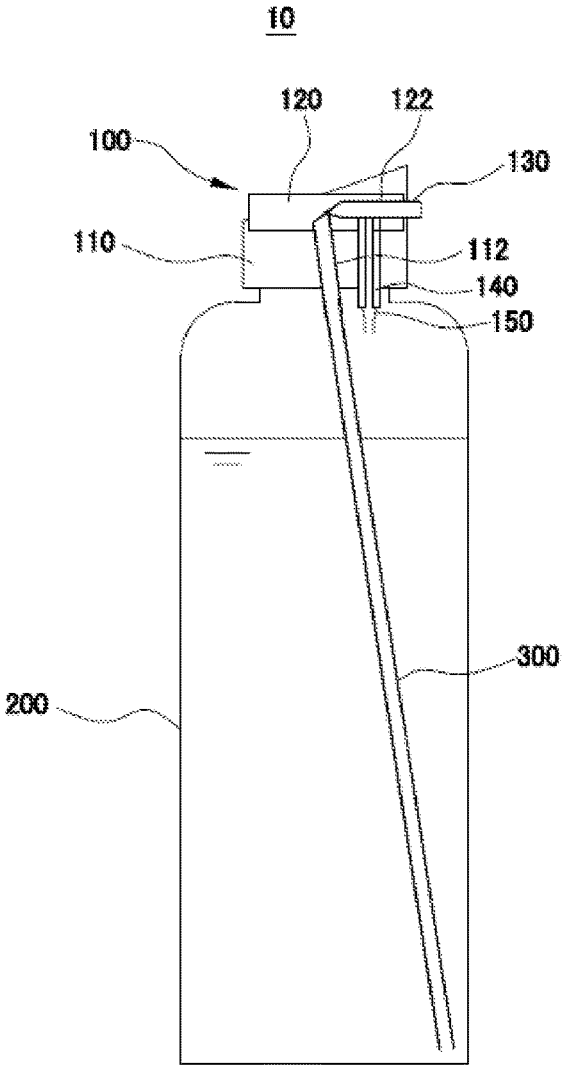
FIG. 1 is a schematic view of a bottle including a discharge-type cap according to an embodiment of the present disclosure.

Hereinafter, embodiments of the present disclosure will be described in detail with reference to the accompanying drawings such that those skilled in the art to which the present disclosure pertains may easily implement. However, the present disclosure may be implemented in several different forms and is not limited to the embodiments described herein. In order to clearly describe the present disclosure in the drawings, parts irrelevant to the description are omitted, and similar reference numerals are attached to similar parts throughout the specification.

Throughout the present specification, when a part is "connected" to another part, this includes not only a case of being "directly connected" but also a case of being "electrically connected" with another element interposed therebetween.

Throughout the present specification, when a member is described to be placed "on" another member, this includes not only a case in which the member is in contact with another member but also a case in which there is still another member between the two members.

Throughout the present specification, when a part "includes" a certain component, this indicates that other components may be further included therein, rather than excluding other components, unless otherwise stated. As used throughout the present specification, terms "about", "approximately", "substantially," and so on are used in a sense at or close to the numerical value when manufacturing and material tolerances inherent in the stated meaning are presented and are used to prevent described accurate or absolute numerical values from unduly using by an unconscionable infringer to aid understanding of the present disclosure. A term a "step of performing" or a "step of" used throughout the present specification does not indicate a "step for".

The present disclosure relates to a discharge-type cap and a bottle including the same.

Figure 2:
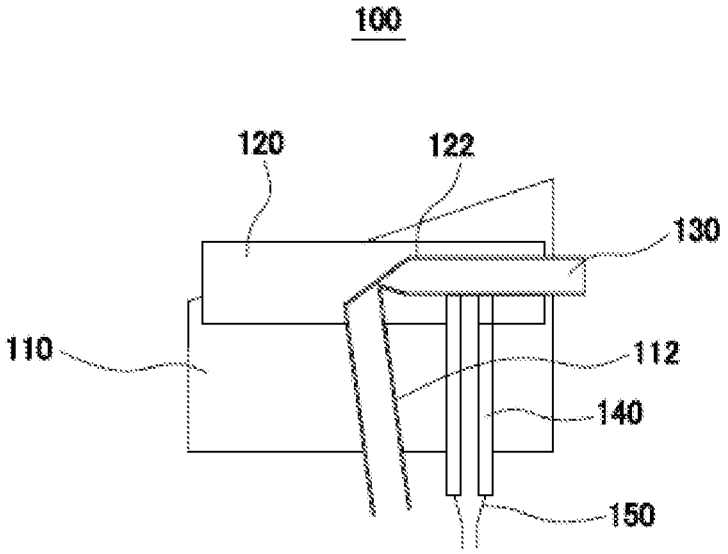
FIG. 2 is a schematic view of a discharge-type cap according to an embodiment of the present disclosure.
Figure 3:
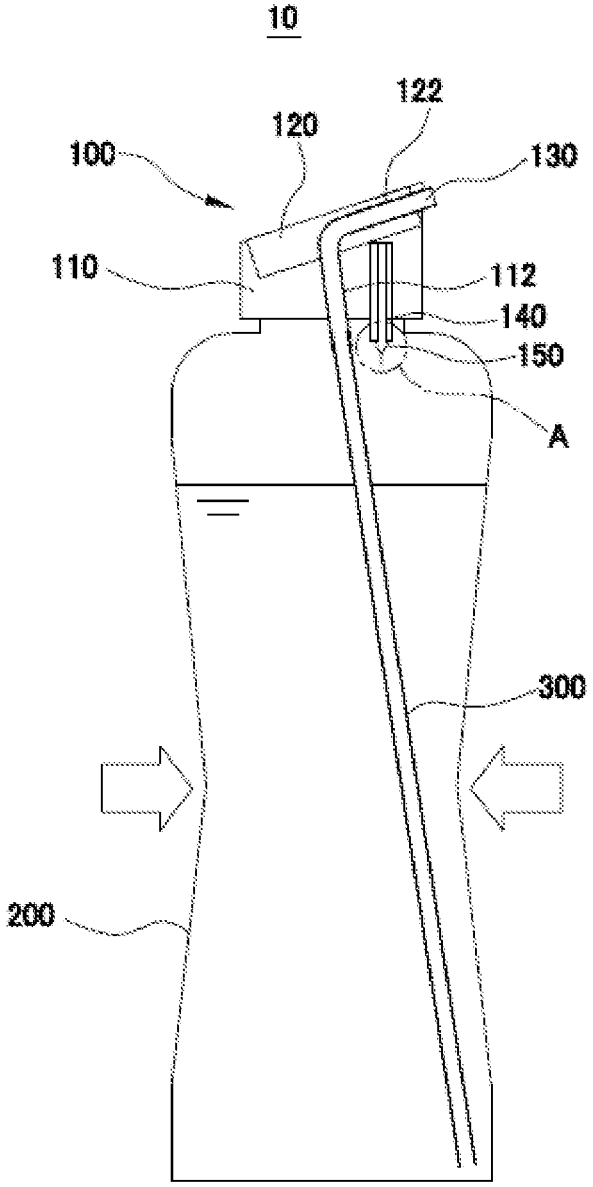
FIGS. 3 and 4 are views illustrating a principle of ejecting a liquid filled in a bottle, according to an embodiment of the present disclosure.
Figure 4:
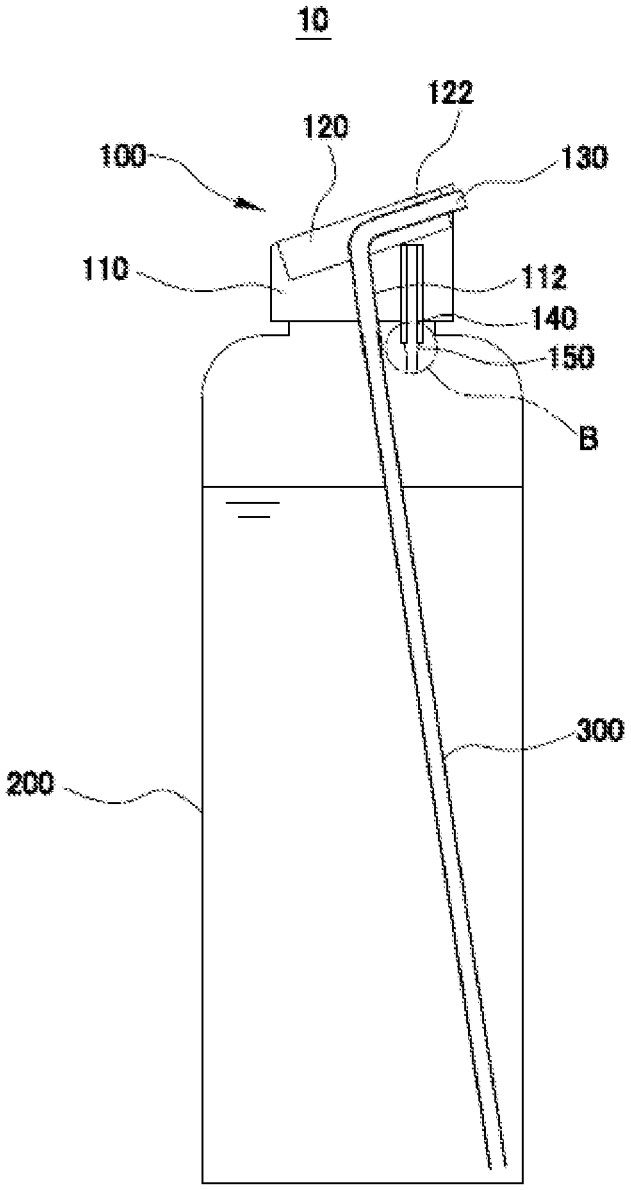
Figure 5A:
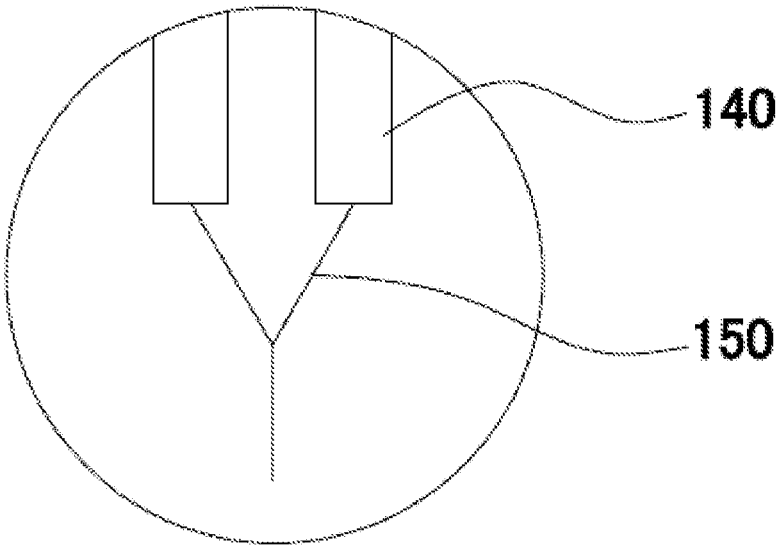
FIGS. 5A and 5B illustrate enlarged views of A of FIG. 3 and B of FIG. 4.
Figure 5B:
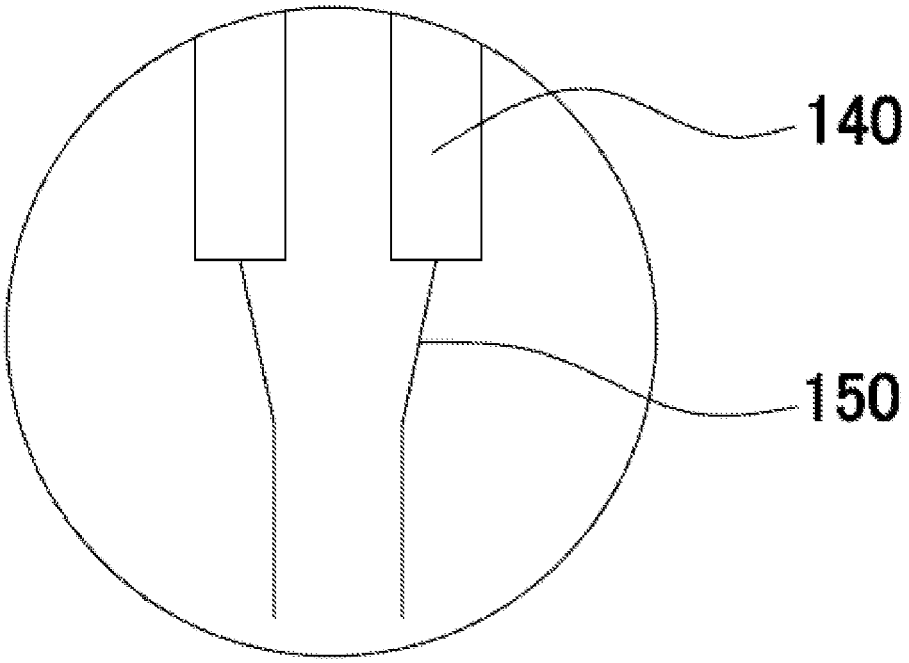

FIG. 1 is a schematic view of a bottle including a discharge-type cap according to an embodiment of the present disclosure, FIG. 2 is a schematic view of a discharge-type cap according to an embodiment of the present disclosure, FIGS. 3 and 4 are views illustrating a principle of ejecting a liquid filled in a bottle, according to an embodiment of the present disclosure, and FIGS. 5A and 5B illustrate enlarged views of A of FIG. 3 and B of FIG. 4

Hereinafter, a bottle 10 (hereinafter, referred to as a "bottle 10") including a discharge-type cap according to an embodiment of the present disclosure will be described with reference to FIG. 1.

Referring to FIG. 1, the bottle 10 includes a discharge-type cap, a straw 300, and a container 200.

A discharge-type cap 100 may be coupled to an upper portion of the container 200, and an ejection hole for ejecting a liquid filled in the container 200 to the outside may be formed. For example, the discharge-type cap 100 may include a threaded inner circumferential surface to be screwed to the upper portion of the container 200 but is not limited thereto.

The straw 300 is coupled to a lower end of a lower tube insertion hole 112 of the discharge-type cap 100 to be described below. For example, the straw 300 may be made to have a sufficient length such that an end portion thereof is located on an inner lower periphery portion of the container 200 and may be made of a polypropylene (PP) material that is not easily deformed even at a high temperature but is not limited thereto.

The container 200 is preferably made of a flexible material so as to be deformed when a user pressurizes the container 200 with preset force or more after the discharge-type cap 100 is coupled to the upper portion of the container 200. In other words, when the container 200 is pressurized, the bottle 10 is deformed to increase an internal pressure such that a liquid filled in the container 200 is pressurized, and thus, the liquid may be ejected to the ejection hole of the discharge-type cap 100 through the straw 300. Detailed description thereof will be given below.

Hereinafter, the discharge-type cap 100 according to an embodiment of the present disclosure will be described in detail with reference to FIGS. 2 to 5B.

The discharge-type cap 100 includes an outer housing 110, a button portion 120, and a tube 130.

The outer housing 110 is detachably coupled to an inner surface of an upper opening of the container 200. For example, the outer housing 110 is formed in a cylindrical shape, a lower surface thereof is recessed in an upper direction, a thread is formed along a circumferential surface, and thus, the outer housing 110 may be coupled to an upper opening of the container 200. In addition, the button portion 120 may be located on an upper portion of the outer housing 110 so as to form a sufficient space for the button portion 120 to rotate.

The button portion 120 may be hinged to the upper portion of the outer housing 110. For example, the button portion 120 is formed in a disk shape, and left and right end portions thereof may be hinged to the outer housing 110 such that rotation thereof may be made. The rotation means that a front-end portion of the button portion 120 is rotatable toward an upper portion at a predetermined angle with respect to the hinged portion.

The button portion 120 is in an open state when pressurizing an opposite portion where the other side of the tube 130 is located, that is, an upper portion in a direction opposite to a direction in which a fluid is ejected and is in a closed state when pressurizing an upper portion of a part where the other side of the tube 130 is located.

One end of the tube 130 is located under the outer housing 110, and the other end thereof is located on a side of the button portion 120.

In addition, the button portion 120 may include an upper tube insertion hole 122 which has a lower surface and a side surface communicating each other and into which the tube 130 is inserted, and the outer housing 110 may include a lower tube insertion hole 112 having a central portion into which the tube 130 is inserted and inclined in a direction in which the other end of the tube 130 is located. For example, the upper tube insertion hole 122 may be formed in an "L" shape, and the lower tube insertion hole 112 may be formed to be inclined such that an angle of the tube 130 is reduced in a bent portion of the upper tube insertion hole 122.

In other words, the tube 130 is coupled through the upper tube insertion hole 122 and the lower tube insertion hole 112, and because the lower tube insertion hole 112 is formed to be inclined, when the button portion 120 is in a closed state, the tube 130 has an angle of 40 to 70 degrees, and thus, the tube 130 may be folded and closed. Accordingly, when the button portion 120 is in the closed state, the liquid in the container 200 may be prevented from being ejected to the outside through the tube 130. In addition, when the button portion 120 is rotated to be in an open state, the tube 130 has an angle of 90 degrees to cause the tube 130 to be in the open state, and thus, the tube 130 is in the open state and the liquid in the container 200 may be ejected to the outside through the container 200. At this time, the tube 130 is preferably formed of a flexible silicone material such that the tube 130 is folded to block a passage through which the liquid passes.

In addition, referring to FIGS. 3 and 4, in the discharge-type cap 100, when the container 200 is pressurized, a liquid in the container 200 is ejected to the outside through the tube 130, and when force pressurizing the container 200 is released, the container 200 may be restored to an original state by restoring force.

Specifically, when the container 200 is pressurized, a pressure inside the container 200 increases to cause air in the container 200 to pressurize the liquid, and thus, the pressurized liquid may be supplied to the tube 130 through the straw 300 and ejected to the outside. When the force pressurizing the container 200 is released, external air is introduced to reduce an internal pressure of the container 200, and thus, the container 200 may return to an original state by the restoring force.

To this end, the discharge-type cap 100 may further include an air backflow prevention portion 150 that is located at a lower portion where the tube 130 of the button portion 120 is located and is located at a lower end of the air suction portion 140 communicating up and down and is closed when the internal pressure of the container 200 is high and is open when the internal pressure is low. In addition, the air backflow prevention portion 150 may be formed of a flexible material and may be formed to have a smaller cross-sectional area toward the bottom.

For example, referring to FIG. 5A, the air backflow prevention portion 150 is formed in a funnel shape, and when the container 200 is pressurized, an inner pressure of the container 200 increases to cause air in the container 200 to pressurize an outer surface of the air backflow prevention portion 150, and thereby, an inlet of the air backflow prevention portion 150 may be closed such that the air suction portion 140 does not communicate with the inside of the container 200. In addition, referring to FIG. 5B, when the force pressurizing the container 200 is released, external air is introduced through the air suction portion 140 to open the air backflow prevention portion 150, and thus, the internal pressure of the container 200 may be reduced.

In addition, when the button portion 120 is in a closed state, a lower surface of the button portion 120 blocks an upper portion of the air suction portion 140, and thus, when not in use, it is possible to prevent external air from flowing into the inside of the container 200. In another embodiment, when the button portion 120 is in the closed state, the tube 130 blocks the upper portion of the air suction portion 140 located on an upper portion of the air backflow prevention portion 150, and thus, it is possible to prevent external air from flowing into the inside of the container 200. At this time, the tube 130 is formed of a flexible material and is in close contact with the upper portion of the air suction portion 140, and thus, there is an effect in which sealing force is increased.

The above description of the present specification is for illustration, and those skilled in the art to which the present disclosure pertains will understand that modification into other specific forms may be easily made without changing the technical idea or essential features of the present disclosure. Therefore, it should be understood that the embodiments described above are example in all respects and not restrictive. For example, components described as a single type may be implemented in a dispersed form, and likewise components described as a dispersed form may also be implemented in a combined form.

The scope of the present disclosure is indicated by following claims rather than the above detailed description, and all changes or modifications derived from the meaning and scope of the claims and their equivalents should be construed as being included in the scope of the present disclosure.

SIGNS LIST

10: bottle
100: discharge-type cap
110: outer housing
112: lower tube insertion hole
120: button portion
122: upper tube insertion hole
130: tube
140: air suction portion
150: air backflow prevention portion
200: container
300: straw

What is claimed is:

1. A discharge-type cap comprising:

an outer housing detachably coupled to an inner surface of an upper opening of a container;

a button portion hinged to an upper portion of the outer housing;

a tube formed of a flexible silicone material having one end located in a lower portion of the outer housing and the other end located on a side of the button portion; and an air suction portion located at a lower portion of the button portion where the tube is located and communicating up and down, wherein the button portion includes an upper tube insertion hole which has a lower surface and a side surface communicating to each other and into which the tube is inserted, the outer housing includes a lower tube insertion hole having a central portion into which the tube is inserted and inclined in a direction in which the other end of the tube is located, the button portion is in an open state when pressurizing an upper portion of an opposite portion where an other side of the tube is located and is in a closed state when pressurizing an upper portion of a part where the other side of the tube is located, when the button portion is in the closed state, the tube is in a folded closed state, and when the button portion is in the open state, the tube is in an open state, and wherein, when the button portion is in the closed state and the tube is in the folded closed state, the lower surface of the tube blocks an upper portion of the air suction portion.

2. The discharge-type cap of claim 1, further comprising:

an air backflow prevention portion that is located at a lower end of the air suction portion and is closed when an internal pressure of the container is high and is opened when the internal pressure is low.

3. The discharge-type cap of claim 2, wherein the air backflow prevention portion is formed of a flexible material and is formed to have a smaller cross-sectional area toward a lower portion of the air backflow prevention portion.

4. A bottle comprising:

a discharge-type cap;

a straw coupled to a lower end of a lower tube insertion hole of the discharge-type cap; and a container coupled to the discharge-type cap, wherein the discharge-type cap includes an outer housing detachably coupled to an inner surface of an upper opening of the container, a button portion hinged to an upper portion of the outer housing, a tube formed of a flexible silicone material having one end located in a lower portion of the outer housing and the other end located on a side of the button portion, and an air suction portion located at a lower portion of the button portion where the tube is located and communicating up and down, the button portion includes an upper tube insertion hole which has a lower surface and a side surface communicating to each other and into which the tube is inserted, the outer housing includes the lower tube insertion hole having a central portion into which the tube is inserted and inclined in a direction in which the other end of the tube is located, the button portion is in an open state when pressurizing an upper portion of an opposite portion where an other side of the tube is located and is in a closed state when pressurizing an upper portion of a part where the other side of the tube is located, when the button portion is in the closed state, the tube is in a folded closed state, and when the button portion is in the open state, the tube is in an open state, and wherein, when the button portion is in the closed state and the tube is in the folded closed state, the lower surface of the tube blocks an upper portion of the air suction portion.

5. The bottle of claim 4, wherein the bottle is made of a flexible material such that the container is deformed when a user pressurizes the container with preset force or more.

6. The bottle of claim 4, further comprising:

an air backflow prevention portion that is located at a lower end of the air suction portion and is closed when an internal pressure of the container is high and is opened when the internal pressure is low.

7. The bottle of claim 6, wherein the air backflow prevention portion is formed of a flexible material and is formed to have a smaller cross-sectional area toward a lower portion of the air backflow prevention portion.

* * * * *